US009518716B1

(12) United States Patent
Householder

(10) Patent No.: US 9,518,716 B1
(45) Date of Patent: Dec. 13, 2016

(54) LINEAR WIDE AREA LIGHTING SYSTEM

(71) Applicant: Universal Lighting Technologies, Inc., Madison, AL (US)

(72) Inventor: John R. Householder, Cedar Park, TX (US)

(73) Assignee: UNIVERSAL LIGHTING TECHNOLOGIES, INC., Madison, AL (US)

( * ) Notice: Subject to any disclaimer, the term of this patent is extended or adjusted under 35 U.S.C. 154(b) by 103 days.

(21) Appl. No.: 14/226,773

(22) Filed: Mar. 26, 2014

Related U.S. Application Data

(60) Provisional application No. 61/805,322, filed on Mar. 26, 2013.

(51) Int. Cl.

| | |
|---|---|
| ***F21V 5/04*** | (2006.01) |
| ***F21V 7/00*** | (2006.01) |
| ***F21S 4/00*** | (2016.01) |
| *F21Y 103/00* | (2016.01) |

(52) U.S. Cl.
CPC ..... *F21V 5/04* (2013.01); *F21S 4/008* (2013.01); *F21V 7/005* (2013.01); *F21Y 2103/003* (2013.01)

(58) Field of Classification Search
CPC .... F21Y 2103/003; F21V 5/007; F21V 7/005; F21V 17/04; F21V 5/04; F21S 4/008
See application file for complete search history.

(56) References Cited

U.S. PATENT DOCUMENTS

| | | | | |
|---|---|---|---|---|
| 8,876,325 | B2 * | 11/2014 | Lu | G02B 19/0066 362/217.02 |
| 9,057,493 | B2 * | 6/2015 | Simon | F21K 9/17 |
| 9,127,874 | B2 * | 9/2015 | Ye | F21V 31/005 |
| 2011/0090688 | A1 * | 4/2011 | Lai | F21V 5/007 362/235 |
| 2011/0141734 | A1 * | 6/2011 | Li | F21K 9/17 362/235 |
| 2012/0140461 | A1 * | 6/2012 | Pickard | F21S 4/003 362/225 |
| 2015/0023021 | A1 * | 1/2015 | Hyun | H01L 33/50 362/293 |

* cited by examiner

*Primary Examiner* — Peggy Neils
(74) *Attorney, Agent, or Firm* — Patterson Intellectual Property Law, P.C.; Mark J. Patterson; Jerry Turner Sewell

(57) ABSTRACT

A linear wide area lighting system includes an elongated substrate having a linear light emitter array disposed on the substrate. The array includes a plurality of light emitters such as light emitting diodes or lamps. An elongated refractive lens is positioned over the substrate and linear light emitter array such that light emitted from the emitters is incident on the refractive lens and is refracted through the lens into a wide illumination area. The lens is extruded in some embodiments providing the lens with a substantially uniform extruded cross-sectional profile in some embodiments. The substrate is housed either between a base and the lens in some embodiments, or in an integrally formed bore in the lens body in other embodiments. One or more end caps are located on the longitudinal ends of the lens and base to fully enclose and seal the substrate and linear light emitter array.

21 Claims, 9 Drawing Sheets

LINEAR WIDE AREA LIGHTING SYSTEM

CROSS-REFERENCES TO RELATED APPLICATIONS

This nonprovisional patent application claims benefit of and priority to U.S. Provisional patent application Ser. No. 61/805,322 filed Mar. 26, 2013, entitled Linear Wide Area Lighting System, all of which is hereby incorporated by reference in its entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND OF THE INVENTION

The present invention relates generally to lighting devices and methods for illumination and more particularly to linear lighting devices for wide area light distribution.

Conventional linear lighting devices for wide area light distribution are used in a variety of lighting applications, such as in outdoor lighting, indoor lighting, overhead lighting, luminaires, roadway lighting, and for illuminating sign boxes and other backlit applications. Linear wide area lighting devices operate to emit light over a wide area using an elongated emitter array. This may be achieved using a variety of lighting device configurations. Typically, linear wide area lighting devices include numerous light emitters such as a light emitting diode and an optic, or lens, to distribute the light from the emitters in a desired illumination profile. Some conventional linear wide area lighting devices include lenses having a three-dimensional light refraction profile to achieve light distribution across a wide area in an illumination space. However, lenses having three dimensional lighting profiles are generally more difficult and expensive to manufacture than longitudinal lenses which refract light in two dimensions as opposed to three dimensions.

Linear wide area lighting devices of this nature are commonly arranged in longitudinal strips or strands of lights that may be arranged in a linear or semi-linear orientation. Multiple strands may be positioned together in an end-to-end configuration or in a side-by-side configuration depending on the particular application. For example, devices for illuminating sign boxes include one or more longitudinal light devices arranged on the interior of a sign box or other enclosure. Multiple devices are added for larger enclosures.

Conventional linear wide area lighting devices also include numerous lighting modules wired together in series. Each module includes multiple emitters and individual optics. Such configurations are costly to manufacture as each module has its own independent set of parts including housing, lens, circuit board, etc., resulting in a high number of parts for a single linear lighting application. Additionally, such configurations require independent fasteners for each module within a fixture or other mounting application, and each module spans only a relatively small distance compared to the overall linear lighting dimension.

Each device in a conventional linear wide area lighting device typically includes multiple light emitters. Emitters may take many forms, including but not limited light emitting diodes, conventional bulbs, lamps, or other emitters. Each emitter is connected to an electrical circuit included on the device. In some applications, multiple light emitting diodes are positioned on one or more substrates and are connected to a light emitting diode driver circuit to provide power and control for illumination. One or more lenses are positioned over each emitter to provide distribution of the emitted light across a wide area. Each lens may be shaped to provide a desired illumination profile. High part counts and module counts associated with conventional lighting devices, combined with complex lens geometries for three-dimensional light distribution, result in complex designs and high costs of manufacturing. Additionally, using conventional modular linear systems, numerous modules are required to achieve a desired luminance output.

What is needed then are improvements in linear lighting devices and systems for wide area light distribution.

BRIEF SUMMARY

The present invention provides a lighting apparatus for linear wide area lighting applications including an emitter substrate such as a printed circuit board, a linear array of light emitters disposed on the substrate, and a longitudinal lens positioned over the emitters. In some embodiments, the lens is extruded and includes a two dimensional refraction profile substantially transverse to the longitudinal axis. Each emitter in the linear array of emitters emits light that is refracted by the lens and distributed outwardly for a lighting application.

In some embodiments, the present invention includes a lighting apparatus including an elongated lens body having a bore defined longitudinally through the lens along a longitudinal axis. A substrate is positioned in the bore, and a first linear light emitter array is disposed on the substrate. The first linear light emitter array includes a plurality of light emitters in longitudinally spaced relation to each other. A first longitudinal refractive lens is integrally formed on the lens body positioned over the first linear light emitter array. In some embodiments, the lens includes a two-dimensional refractive distribution profile.

A further objective of the present disclosure is to provide a lighting device including a lens body with an integral bore for housing a linear array of light emitting diodes.

Another object of the present disclosure is to provide a light device having a base and a longitudinal refractive lens forming a space therebetween for housing a linear array of light emitting diodes.

Yet another object of the present disclosure is to provide a low-cost linear wide area lighting device having an extruded refractive lens covering a linear array of light emitting diodes.

A further object of the present disclosure is to provide a linear lighting apparatus having a single integrated lens body defining a bore, and a double-sided printed circuit board substrate is positioned in the bore, wherein a first linear array of light emitting diodes emits light from a first side of the substrate and a second linear array of light emitting diodes emits light from a second side of the substrate opposite the first side.

Another object of the present invention is to provide a lighting device having a longitudinal extruded two-dimensional refractive lens and a base, wherein the base can be easily interconnected to like bases to form a lighting device that emits light in opposite directions.

Numerous other objects, advantages and features of the present invention will be readily apparent to those of skill in the art upon a review of the following drawings and description of a preferred embodiment.

DETAILED DESCRIPTION

Figure 1:
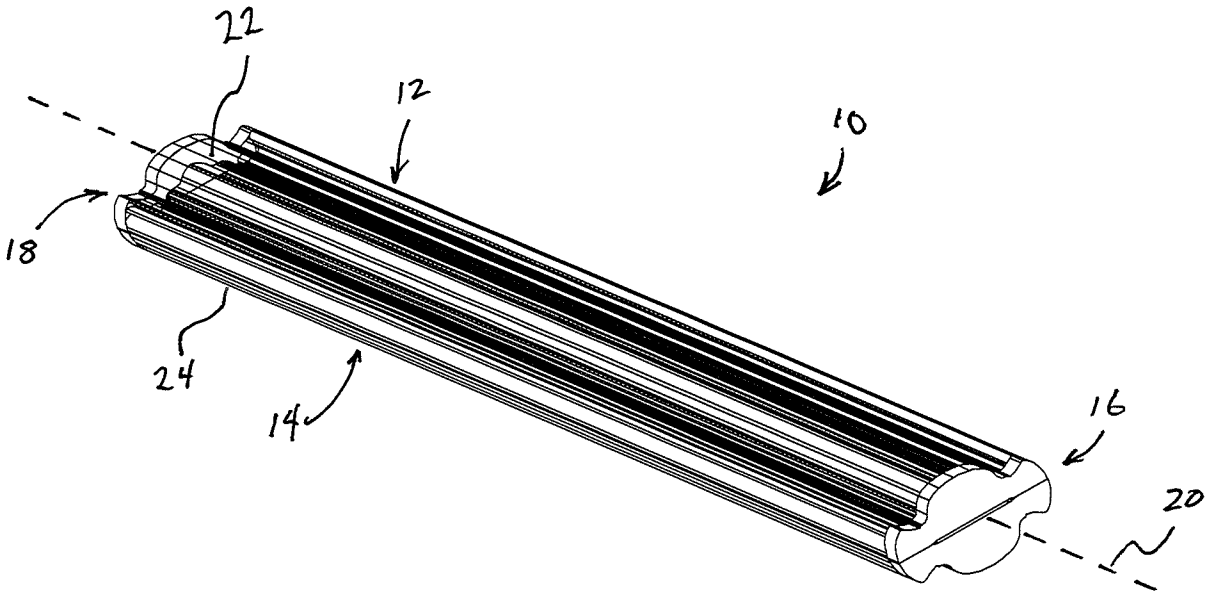
FIG. 1 illustrates a perspective view of an embodiment of a lighting apparatus.

Referring now to the drawings, FIG. 1 illustrates an embodiment of a linear wide area lighting device 10, or lighting apparatus, in a first embodiment. Lighting device 10 is elongated along a longitudinal axis 20. Lighting device 10 includes a first device side 12 and a second device side 14. Lighting device 10 also includes a first longitudinal end 16 and a second longitudinal end 18. Lighting device 10 may be configured to emit light form one or both of first and second device sides 12, 14.

In some embodiments, lighting device 10 includes a first lens 22, or first optic. First lens 22 includes an elongated refractive lens in some embodiments. First lens 22 may be formed of any suitable optic lens material, such as plastic or glass. First lens 22 may be extruded to reduce manufacturing and production costs in some applications. First lens 22 may be formed using other manufacturing techniques in additional embodiments.

Figure 2:
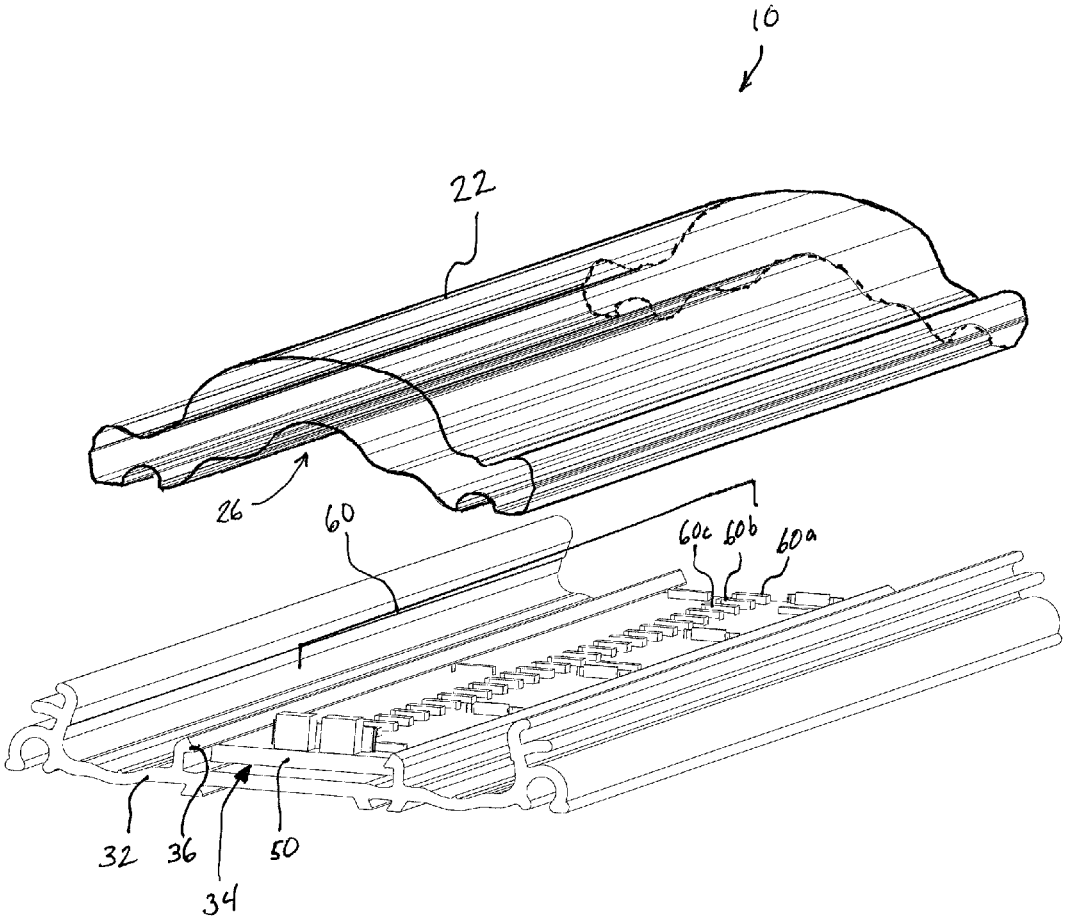
FIG. 2 illustrates a partially exploded perspective view of an embodiment of a lighting apparatus.

Referring to FIG. 2, first lens 22 is generally positioned over an elongated substrate 50. Substrate 50 is housed within first lens 22 or is partially covered by first lens 22 in various applications. Substrate 50 includes an elongated printed circuit board in some embodiments. Substrate 50 can include either a single-sided or a double-sided printed circuit board, depending on the particular application. Substrate 50 includes one or more electronic circuit components positioned on the substrate. The components on substrate 50 form an electronic circuit that can be connected to an external power supply or external control.

Figure 10:
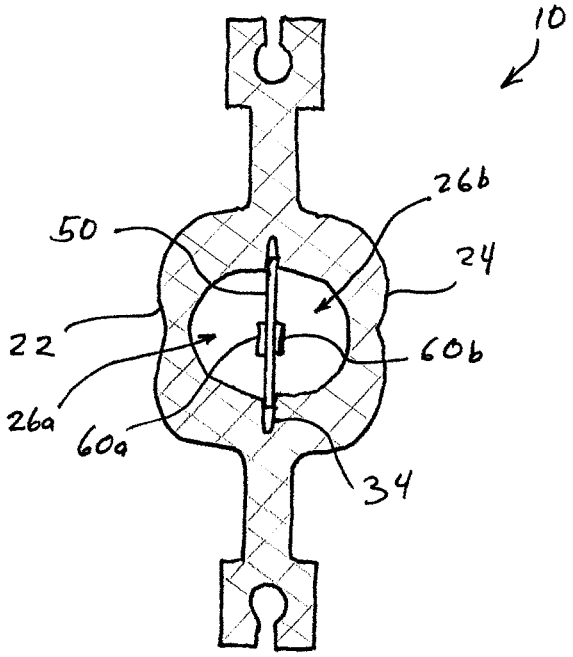
FIG. 10 illustrates a partial cross-sectional view of an alternative embodiment of a lighting device.

A linear light emitter array 60 is positioned on substrate 50 in some embodiments, as seen in FIG. 2. Light emitter array 60 includes a plurality of light emitters 60*a*, 60*b*, 60*c*, etc. located on substrate 50. Each emitter may include a surface mount emitter component such as a light emitting diode (LED), a lamp, or any other suitable type of light emitter. The emitters in array 60 are arranged in a substantially linear arrangement in some embodiments, as seen for example in FIG. 2. The array of emitters may be characterized as a linear light emitter array where the emitters are generally positioned in a spaced arrangement along the direction of the longitudinal axis 20. The emitters need not be located in a perfect line to be considered a linear array of light emitters. In some embodiments, each emitter in the linear light emitter array is spaced evenly from its adjacent emitters to provide a uniform illumination profile. In some embodiments, a first linear light emitter array 60*a* is positioned on the first side of substrate 50, and a second linear light emitter array 60*b* is positioned on the second side of substrate 50, as seen in FIG. 10. In such embodiments, substrate 50 is a double-sided printed circuit board and light is emitted from both sides of the lighting device.

Figure 3:
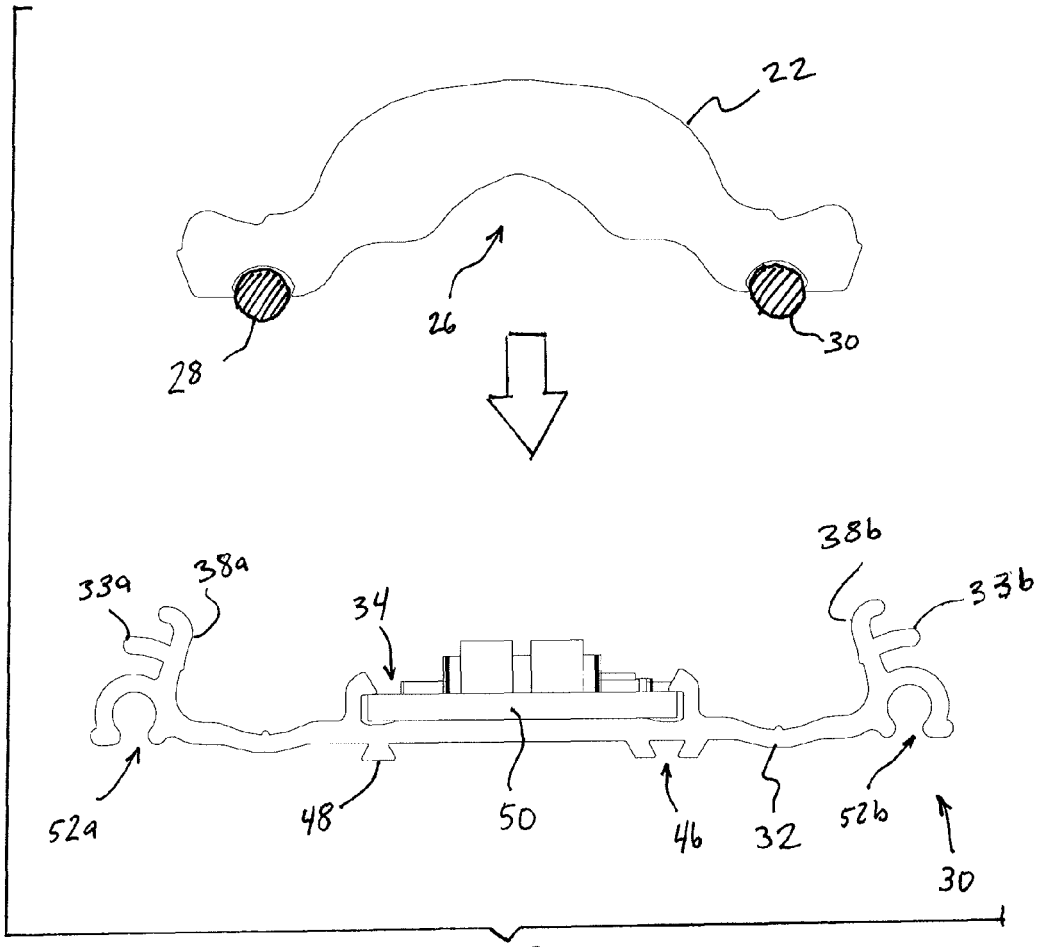
FIG. 3 illustrates a partially exploded end view of the embodiment of a lighting apparatus from FIG. 2.
Figure 4:
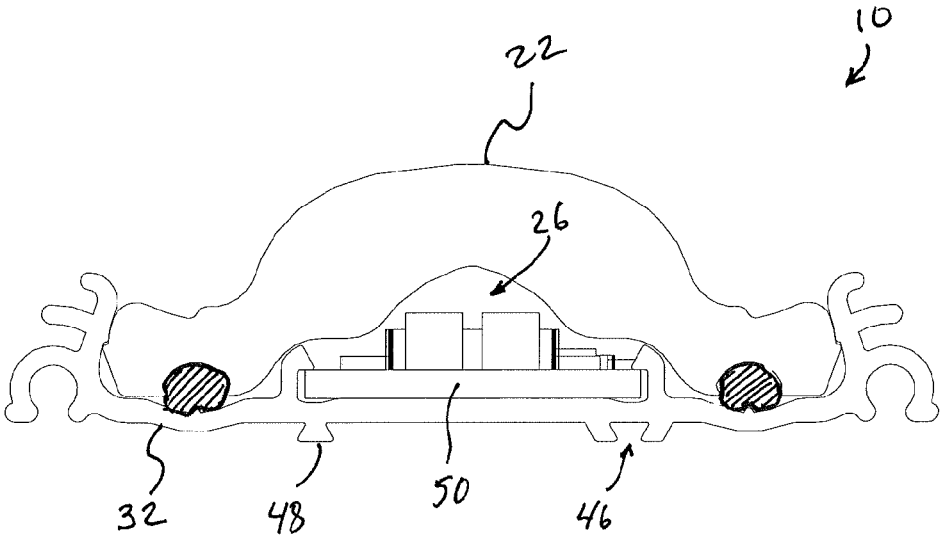
FIG. 4 illustrates a partially assembled end view of the embodiment of a lighting apparatus from FIG. 2.

Referring further to FIGS. 2-5, a longitudinal lens recess 26 is formed in lens 22 in some embodiments. Lens recess 26 provides space for accommodating circuit components positioned on substrate 50. For example, as seen in FIG. 4, circuit components protrude from a side of substrate 50 toward first lens 22. The circuit components require space to be housed between substrate 50 and lens 22, and the lens recess 26 provides the necessary space. Lens recess 26 may be formed in the extruded first lens 22 along the entire longitudinal length of first lens 22 in some embodiments.

Each emitter emits light in a direction away from substrate 50. When first lens 22 is positioned over the substrate 50, light from the first array of emitters 60 is incident on the interior side of the first lens 22. The light is then refracted through the lens 22 and is transmitted from the outer side of the lens facing away from substrate 50. The cross-sectional geometry of first lens 22 influences the refractive illumination profile of light leaving the lens 22. In some embodiments, first lens 22 is extruded and includes a substantially uniform cross-sectional profile. As such, in some embodiments, first lens 22 is configured to provide a primarily two-dimensional refraction pattern substantially transverse to the longitudinal axis. The two-dimensional nature of the refraction profile is due to the substantially uniform cross-sectional shape of the first lens in some embodiments.

Illumination of a wide area is achieved by the combination of refraction patterns from the numerous emitters in the linear array. The lighting device creates a wide area lighting distribution via a linear array of longitudinally spaced light emitters operating as a light source and a first lens 22 operating as an optic. The geometry of first lens 22 creates a wide area beam spread using a refractive profile to redirect the light from each of the emitters into a wide area distribution.

During use, one or more light devices 10 may be used in combination. For example, two or more light devices 10 may be positioned near each other in an end-to-end or a side-by-side configuration to provide a desired light output. Such applications include lighting devices inside side boxes, luminaires, outdoor and indoor lighting applications, roadway lighting, and overhead lighting applications.

Referring further to FIG. 2, in some embodiments, a base 32 is provided on lighting device 10. Base 32 includes a support for mounting the substrate 50 as well as first lens 22. Base 32 includes an extruded material such as a metal or plastic in some embodiments. By extruding both base 32 and first lens 22 in some embodiments, manufacturing costs may be reduced over other manufacturing procedures. Additionally, extrusion of base 32 and first lens 22 allows a consistent cross-sectional profile to be achieved across the longitudinal dimension of the device. Additionally, extrusion of the lens may be achieved using a low cost plastic extrusion process to provide a two-dimensional refractive lens.

Base 32 includes a substrate channel, or substrate groove 34, in some embodiments. Substrate channel 34 includes a longitudinal recess or groove shaped to receive substrate 50. As seen in FIG. 2 and FIG. 3, substrate channel 34 includes two opposing flanges, or substrate retainers 36, that grip against the longitudinal edges of substrate 50 in some embodiments. Each substrate retainer 36 includes a longitudinal flange protruding from base 32 adjacent substrate channel 34 in some embodiments. Substrate 50 is clamped between opposing substrate retainers in some applications. Substrate 50 may be slid longitudinally into substrate channel 34 in some embodiments or inserted in a direction normal to the longitudinal axis in other embodiments. Substrate 50 is held or retained in contact with base 34 in some applications to allow heat transfer from substrate 50 to the base 32 whereby base 32 operates as a heat sink, or heat exchanger. As such, base 32 includes one or more longitudinal heat transfer fins 33*a*, 33*b* in some embodiments.

In addition to securing substrate 50 in place, base 32 may also be operable to secure first lens 22 in place over substrate 50. For example, as seen in FIG. 3 and FIG. 4, base 32 includes first and second lens retainers 38*a*, 38*b*. Each lens retainer includes a flange extending from base 32. Opposite lens retainers are spaced from each other in a dimension to receive the lens 22 therebetween. Each lens retainer may flex slightly relative to the base 32 in some embodiments to allow lens 22 to be inserted between the lens retainers in a slight interference fit. In other embodiments, each lens retainer is rigid, and first lens 22 is slid longitudinally onto base 32 between opposing lens retainers. First and second longitudinal seals 28, 30 are also positioned between base 32 and first lens 22 in some embodiments, as seen in FIG. 4. Each longitudinal seal prevents moisture or debris from entering the region enclosed between base 32 and lens 22 where substrate 50 and its circuit components such as light emitters are housed. Each seal may include any suitable seal material such as rubber, plastic, or silicone.

Figure 8:
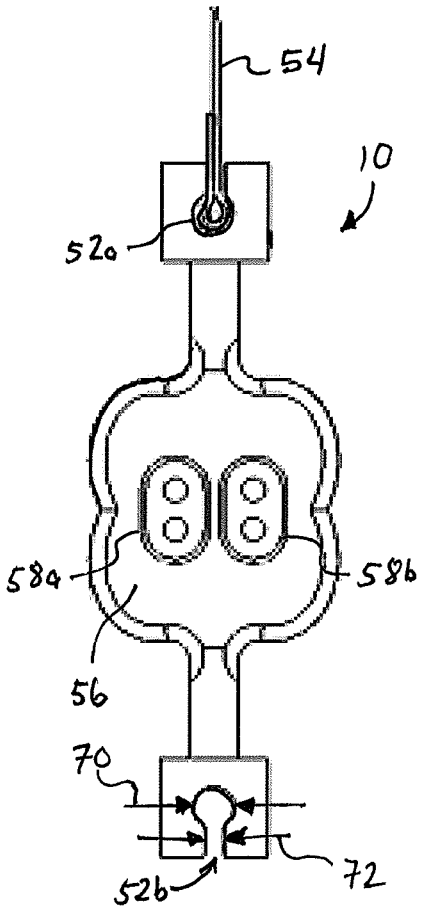
FIG. 8 illustrates an end elevation view of an embodiment of a lighting device.

One or more mounting slots 52*a*, 52*b* are also defined on base 32 in some embodiments. In some applications it is desirable to be able to mount lighting device 10 in a fixture or on another structure. Each mounting slot 52 may be integrally formed in either base 32 or lens 22. Integral mounting slots 52*a*, 52*b* provide a simple way to mount the lighting device 10 in a fixture or on another structure. Additionally, mounting slots allow multiple lighting devices to be interconnected to each other in some embodiments. As seen in FIG. 3 and FIG. 8, each mounting slot includes a longitudinal slot having a transverse opening with an opening dimension 72. Each slot also includes a major slot dimension 70 greater than the opening dimension. As such, an item installed in the slot with a dimension greater than the opening dimension 72 will be retained in the slot. One or more mounting brackets 54, seen for example in FIG. 6 and FIG. 8, may be slid into a mounting slot and retained there to secure the lighting device to another structure. Additionally, the mounting slots allow the lighting device to be repositioned longitudinally without having to move the mounting brackets inside a fixture. The mounting slots also allow the lighting device to be mounted on a rail or other structure. Additionally, the longitudinal mounting slots allow a lighting device 10 to be longitudinally slid off a bracket assembly without removing the bracket assembly. This is advantageous when replacing or changing out lighting devices in a fixed location.

Figure 5:
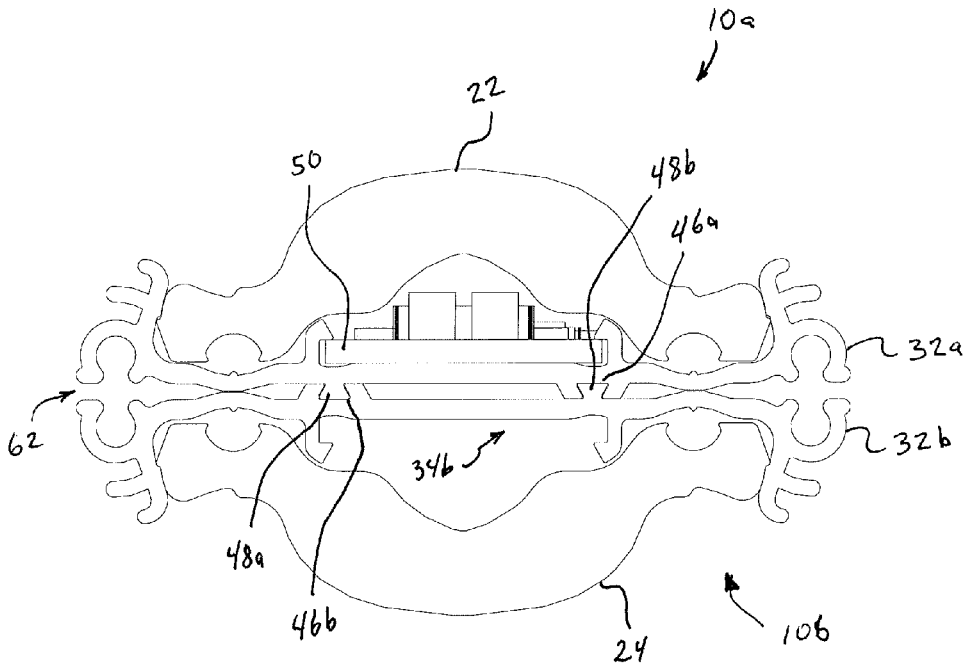
FIG. 5 illustrates a partially assembled end view of an alternative embodiment of lighting apparatus.

In some applications, it is desirable to provide light output from both sides of the lighting device. For example, some sign boxes require illumination on both sides of the sign box. This may be achieved in a number of different ways. For example, in some applications, two of the lighting devices shown in FIG. 4 may be positioned back-to-back, as seen in FIG. 5, to allow dual-sided illumination. Base 32 is configured to allow ease of use in such configurations by providing a base mounting groove 46 and a base mounting flange 48. The base mounting groove 46 includes a groove dimensioned to receive a corresponding base mounting flange 48, as seen in FIGS. 4 and 5. The flange and groove each include a dovetail shape to enhance interconnection in some embodiments. Two bases may be joined simply by sliding a first base mounting flange 48*a* on a first device longitudinally into a first base mounting groove 46*a* on a second device while at the same time sliding a second base mounting flange 48*b* longitudinally into a second base mounting groove 46*b*. These features allow a single base 32 to be joined with another single like base without the need for additional hardware or other tools.

In a double-sided configuration, as seen in FIG. 5, a first lens 22 refracts light in a first direction and a second lens 24 refracts light in the opposite second direction. In such applications, it may still be desirable to mount the combined first and second devices 10*a*, 10*b* to one or mounting brackets in a fixture or on another structure. To achieve this, a base gap 62 is defined between opposing base mounting slots to allow passage of a mounting bracket or rail between the bases for mounting the combined first and second lighting devices 10*a*, 10*b* to a fixture or other structure.

Figure 6:
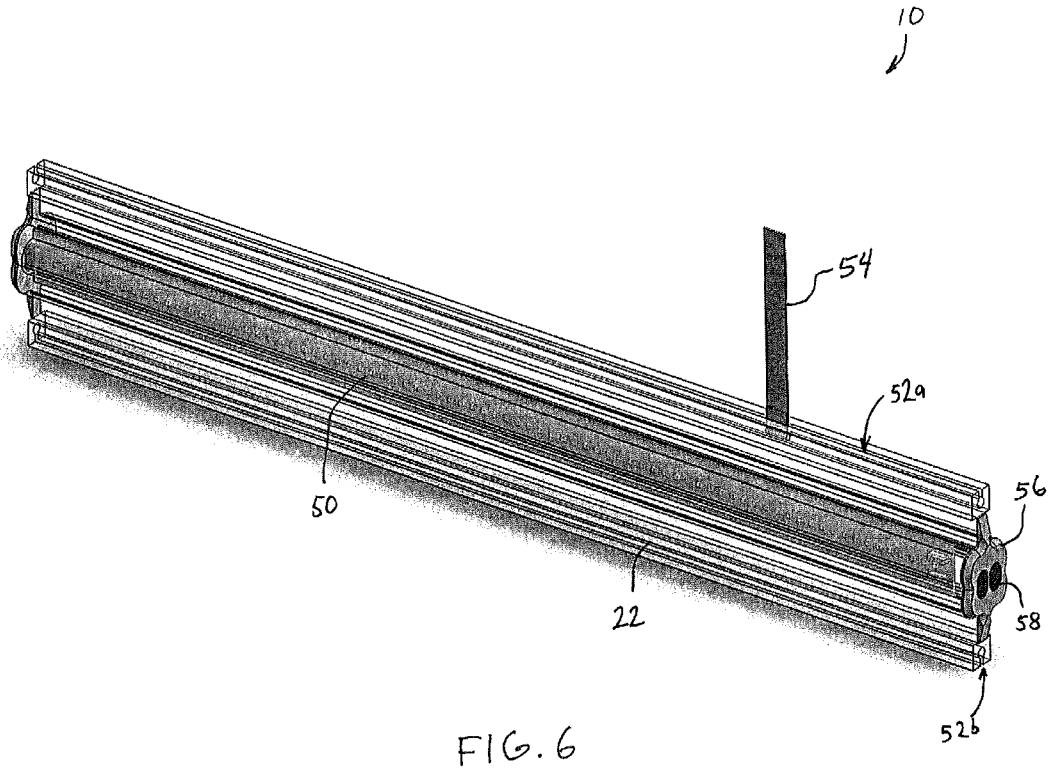
FIG. 6 illustrates a perspective view of an alternative embodiment of a lighting device.
Figure 9:
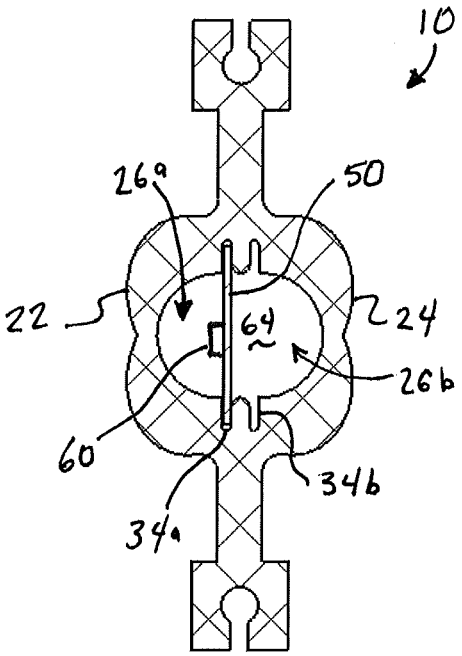
FIG. 9 illustrates a partial cross-sectional view of an alternative embodiment of a lighting device.

In further embodiments, a lens body forms an integral housing for substrate 50 and no base member is present. For example, as seen in FIG. 6 and FIG. 9, the lens body includes an elongated refractive lens material that includes a longitudinal bore 64. The bore extends through the lens body and forms a hollow housing cavity for receiving one or more substrates 50. As seen in FIG. 9, a substrate 50 may be mounted directly into the bore 64 in the lens body. The lens body includes a first lens recess 26*a* shaped and positioned to accommodate electronic circuit components that protrude from the surface of substrate 50 toward the lens body. A first refractive lens 22 is located on a first side of the lens body, and a second refractive lens 24 is located on a second side of the lens body. The first and second refractive lenses 22, 24 operate to distribute light from the light emitter arrays on one or both sides of the substrate 50 away from the lighting device 10. The first lens 22 is integrally formed on the lens body in a one-piece, continuous arrangement in some embodiments. Similarly, the second lens 24 is also integrally formed on the lens body in a one-piece, continuous arrangement in additional embodiments.

One or more substrate channels 34*a*, 34*b* may be formed integrally into the lens body in some embodiments, as seen in FIG. 9. Each substrate channel provides a slot or groove to receive a longitudinal edge of substrate 50. Substrate 50 may be slid longitudinally into the bore 64 such that one or both longitudinal edges of substrate 50 are received in a corresponding substrate channel. The lens body in this configuration may be extruded, molded, or manufactured using any other suitable manufacturing procedure. The lens body includes a substantially uniform cross-sectional profile across the entire longitudinal length of the lens body in some applications. The first lens 22 and second lens 24 are refractive lenses that produce an illumination profile in a two-dimensional plane substantially transverse to the longitudinal axis in some embodiments. First and second lenses 22, 24 are integrally formed in the extruded longitudinal lens body in some embodiments. In further embodiments, each lens may include a more complex three-dimensional refractive illumination profile.

Figure 7:
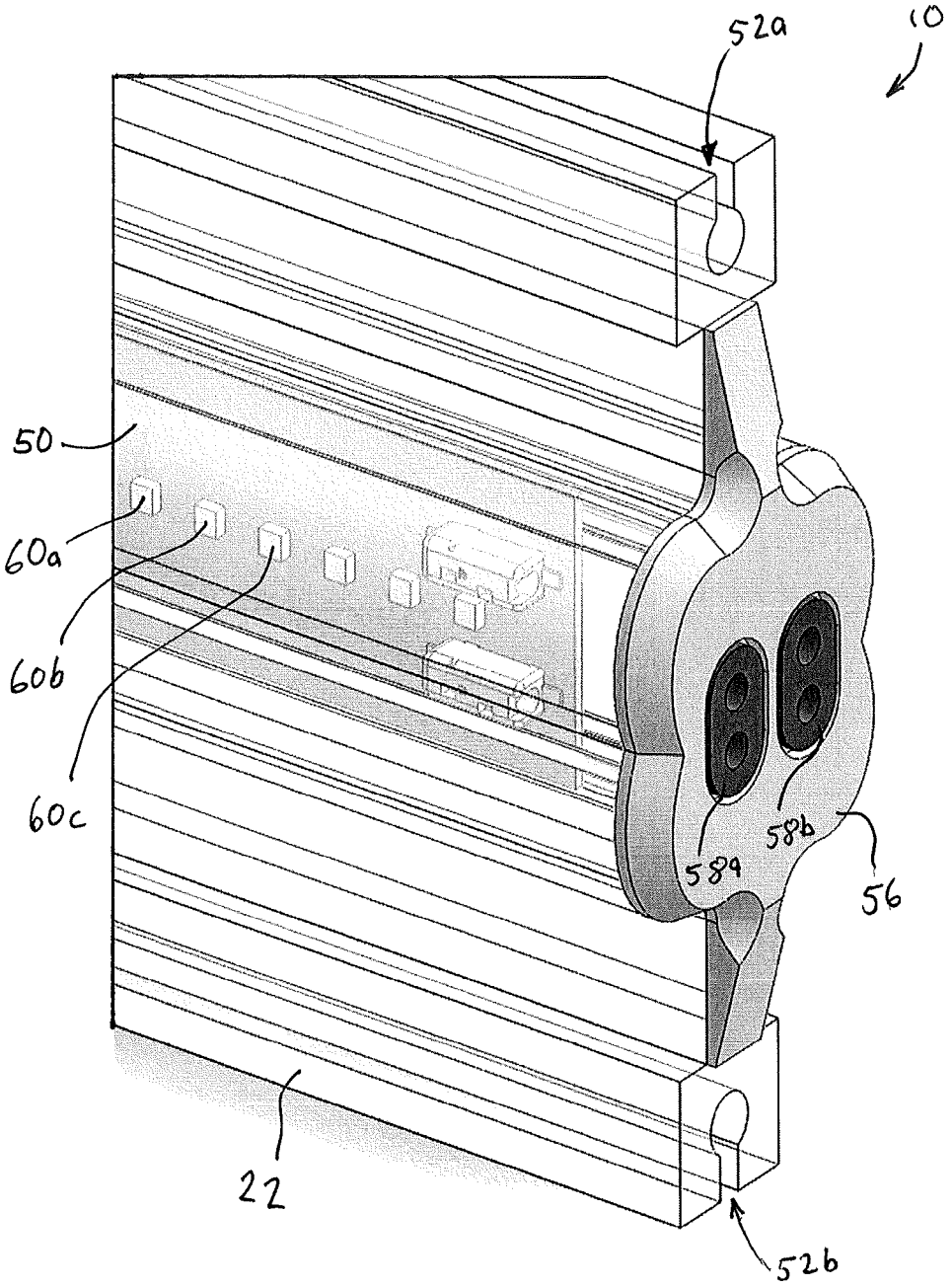
FIG. 7 illustrates a detail perspective end view of the embodiment of a lighting device of FIG. 6.

In many applications, it is desirable to provide substrate 50 in a sealed environment. As seen in FIG. 6 and FIG. 7, in some embodiments, lighting device 10 includes one or more end caps 56 located on each longitudinal ends of the light device 10. Each end cap covers the longitudinal bore opening and provides a seal preventing debris and moisture from entering the longitudinal bore. Alternatively, each end cap covers the open end formed between base 32 and first lens 22, as well as base 32 and second lens 24, in the embodiments seen in FIGS. 1-5. Each end cap can include any suitable material such as tape, adhesive, a plug or an end cap. In some embodiments, as seen in FIG. 7, one or more electrical connectors 58*a*, 58*b* are installed on each end cap. Each electrical connector may be connected to a circuit disposed on substrate 50. The electrical connectors allow the lighting device 10 to be connected to a power source, a control circuit, and/or another lighting device. Each electrical connector includes a sealed grommet installed in the end cap in some embodiments to provide a sealed interface. Additionally, each end cap includes one or more vents in some embodiments to allow venting of volatile organic compounds (VOC) released in the bore during operation to avoid contamination of the light emitting diodes.

Additionally, the lens body shown in FIGS. 6-10 may further include mounting slots 52*a*, 52*b* formed integrally in the lens body to allow mounting or attachment of the lighting device 10 to a fixture or other structure such as mounting bracket 54.

Referring further to FIG. 3, in some embodiments base includes a mounting slot 52*a* defined at the intersection of base 32 and first lens retainer 38*a*. Additionally, one or more first heat sink fins 33*a* are located on first lens retainer 38*a*. Additionally, a second mounting slot 52*b* is defined at the intersection of base 32 and second lens retainer 38*b* in some embodiments, and one or more second heat sink fins 33*b* are located on second lens retainer 38*b*. Mounting slots may be located at other positions on base 32 in various other embodiments.

Thus, although there have been described particular embodiments of the present invention of new and useful Linear Wide Area Lighting System, it is not intended that such references be construed as limitations upon the scope of this invention except as set forth in the following claims.

What is claimed is:

1. A lighting apparatus, comprising:

a substrate having first and second opposing sides, the substrate extending longitudinally in a first direction;

a base defining a substrate channel shaped to receive the substrate, wherein the substrate is installed in the substrate channel of the base;

a longitudinal mounting groove defined in the base;

a longitudinal mounting flange disposed on the base, wherein the longitudinal mounting flange of the base is shaped to be received in a longitudinal mounting groove on a like base;

at least one linear light emitter array disposed on at least one of the first and second opposing sides of the substrate, the array extending longitudinally in the first direction, the light emitter array comprising a plurality of light sources, each light source extending perpendicularly from the at least one of the first and second opposing sides of the substrate in a second direction, the second direction perpendicular to the first direction;

an elongated refractive lens positioned over the substrate, the lens having a longitudinal axis extending in the first direction, the lens having a two-dimensional light refraction profile substantially transverse to the longitudinal axis, the lens including a longitudinal bore extending from a first end of the lens to a second end of the lens, the bore of the lens comprising a longitudinal recess facing the substrate, the plurality of light sources extending into the longitudinal bore; and a first mounting structure coupled to the substrate, the first mounting structure including at least a first longitudinal mounting slot, the first longitudinal mounting slot extending in the first direction parallel to the longitudinal axis, the first longitudinal mounting slot displaced away from the substrate in a third direction, the third direction perpendicular to the first direction and perpendicular to the second direction.

2. The apparatus of claim 1, wherein the substrate is a printed circuit board.

3. The apparatus of claim 2, wherein the plurality of light sources of the light emitter array includes a plurality of light emitting diodes.

4. The apparatus of claim 1, wherein the longitudinal bore includes a longitudinal substrate channel shaped to receive the substrate in the bore.

5. The apparatus of claim 4, where in the substrate is disposed in the bore.

6. The apparatus of claim 5, wherein the substrate is housed entirely within the longitudinal bore in the lens, and a portion of the substrate is received in the substrate channel.

7. The apparatus of claim 1, wherein the base is extruded.

8. The apparatus of claim 1, wherein the bore of the lens comprises a longitudinal recess facing the substrate.

9. The apparatus of claim 1, wherein longitudinal mounting groove and longitudinal mounting flange each have a dovetail configuration.

10. The apparatus of claim 1, wherein the substrate is positioned directly against the base, and the base is operable as a heat sink to extract heat from the substrate.

11. The apparatus of claim 10, further comprising a first longitudinal seal between the lens and the base.

12. The apparatus of claim 11, further comprising a second longitudinal seal between the lens and the base substantially parallel to the first longitudinal seal.

13. A lighting apparatus, comprising:

an elongated lens body having a bore defined longitudinally through the lens body along a longitudinal axis extending in a first direction;

a substrate positioned in the bore, the substrate extending longitudinally in the first direction, the substrate having a first side and a second side;

a first linear light emitter array disposed on the first side of the substrate, the first linear light emitter array including a plurality of light emitters in longitudinally spaced relation to each other, the light emitters extending into the bore of the lens body in a second direction, the second direction perpendicular to the substrate;

a first longitudinal refractive lens portion integrally formed on the lens body, the first longitudinal refractive lens portion positioned over the first linear light emitter array, the first longitudinal refractive lens portion having a two-dimensional refraction profile substantially transverse to the longitudinal axis;

a second linear light emitter array disposed on the second side of the substrate;

a second longitudinal refractive lens portion integrally formed on the lens body, the second longitudinal refractive portion positioned over the second linear light emitter array; and a first mounting structure coupled to the substrate, the first mounting structure including at least a first longitudinal mounting slot, the first longitudinal mounting slot extending in the first direction parallel to the longitudinal axis, the first longitudinal mounting slot displaced away from the substrate in a third direction, the third direction perpendicular to the first direction and perpendicular to the second direction.

14. The apparatus of claim 13, further comprising a substrate channel defined in the lens body along the bore, wherein a portion of the substrate is received in the substrate channel.

15. The apparatus of claim 13, wherein the second longitudinal refractive lens has a two-dimensional refraction profile substantially transverse to the longitudinal axis.

16. The apparatus of claim 13, wherein the lens body and the substrate are secured to a lens base, and wherein the first mounting structure that including the first longitudinal mounting slot is formed into the lens base.

17. The apparatus of claim 13, wherein the first mounting structure including the at least one longitudinal mounting slot is formed into the lens body.

18. The apparatus of claim 13, further including a second mounting structure and a second longitudinal mounting slot, the second longitudinal mounting slot extending parallel to the longitudinal axis, the second longitudinal mounting slot displaced away from the substrate in a fourth direction opposite the second direction, the fourth direction perpendicular to the first direction and perpendicular to the second direction.

19. The apparatus of claim 1, wherein the first mounting structure including the at least one longitudinal mounting slot is formed into the lens base.

20. The apparatus of claim 1, wherein the first mounting structure including the at least one longitudinal mounting slot is formed into the lens.

21. The apparatus of claim 1, further including a second mounting structure and a second longitudinal mounting slot, the second longitudinal mounting slot extending parallel to the longitudinal axis, the second longitudinal mounting slot displaced away from the substrate in a fourth direction opposite the second direction, the fourth direction perpendicular to the first direction and perpendicular to the second direction.

* * * * *